US006494334B1

(12) United States Patent
Cheng

(10) Patent No.: US 6,494,334 B1
(45) Date of Patent: Dec. 17, 2002

(54) STRUCTURE OF A CONTAINER

(76) Inventor: Chih Hung Cheng, P.O. Box 82-144, Taipei (TW)

( * ) Notice: Subject to any disclaimer, the term of this patent is extended or adjusted under 35 U.S.C. 154(b) by 0 days.

(21) Appl. No.: 09/950,886

(22) Filed: Sep. 11, 2001

(51) Int. Cl.[7] ..... B65D 88/55
(52) U.S. Cl. ..... 220/1.5; 220/8
(58) Field of Search ..... 220/1.5, 4.28, 220/8

(56) References Cited

U.S. PATENT DOCUMENTS 5,170,901 A * 12/1992 Bersani ..... 220/1.5
5,732,839 A * 3/1998 Schimmang et al. ..... 220/1.5

* cited by examiner

*Primary Examiner*—Stephen Castellano
(74) *Attorney, Agent, or Firm*—Leong C. Lei

(57) ABSTRACT

A container includes a stationary container having at least an open side and provided with a first pair of rails at upper and lower positions of one inner end thereof, a second pair of rails at upper and lower positions of another inner end thereof, two secondary rails being pivotally connected to each of the rails at lower positions, and a movable container provided with a plurality of roller assemblies which are positioned to be rotatably engaged with the rails to enable the movable container to slide into the stationary container along the rails and slide out of the stationary container along the rails.

4 Claims, 7 Drawing Sheets

STRUCTURE OF A CONTAINER

BACKGROUND OF THE INVENTION

1. Field of the Invention

This invention is related to an improvement in the structure of a container and in particular to one the volume of which can be expanded to twice as required.

2. Description of the Prior Art

The conventional container is a box for cargo, i.e. a large box of a standard size into which goods are packed so that they can be transported securely and efficiently from departure point to destination by road, ship, or rail, without having to be repacked in any way. Nevertheless, such a container is only designed for transporting goods, and cannot be used for other purposes.

Therefore, it is an object of the present invention to provide an improvement in the structure of a container which can obviate and mitigate the above-mentioned drawbacks.

SUMMARY OF THE INVENTION

This invention is related to an improvement in the structure of a container.

It is the primary object of the present invention to provide an improved container the volume of which can be expanded to twice as required.

It is another object of the present invention to provide an improved container which includes a stationary container having at least an open side and provided with a first pair of rails at upper and lower positions of one inner end thereof, a second pair of rails at upper and lower positions of another inner end thereof, two secondary rails being pivotally connected to each of the rails at lower positions, and a movable container provided with a plurality of roller assemblies which are positioned to be rotatably engaged with the rails to enable the movable container to slide into the stationary container along the rails and slide out of the stationary container along the rails.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figures 1A, 1B:
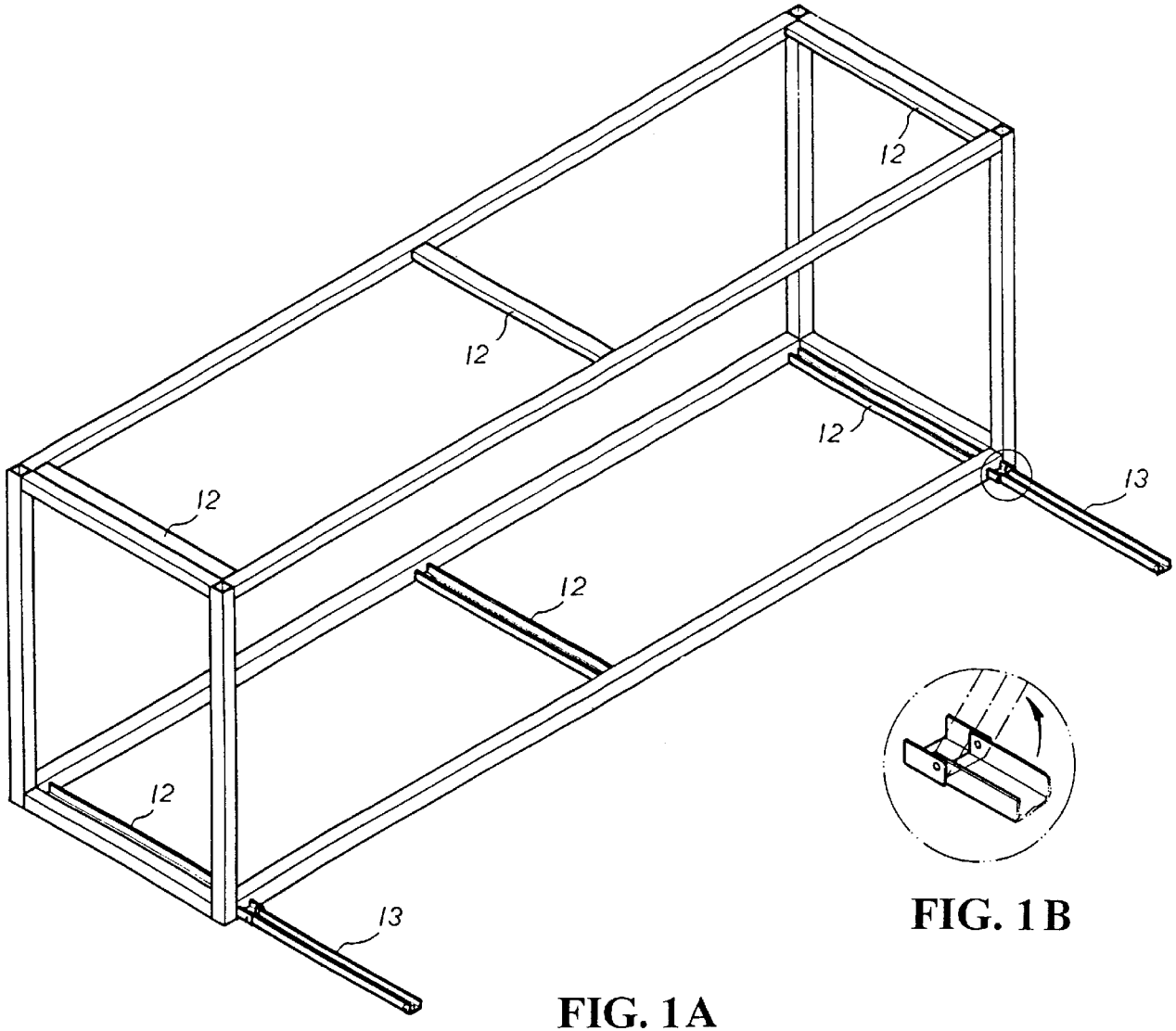
FIG. 1A is a perspective view of a skeleton of stationary container according to the present invention.
FIG. 1B is an enlarged view of a portion of FIG. 1A.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

With reference to the drawings and in particular to FIGS. 1A, 1B, 2 and 3 thereof, the container according to the present invention generally comprises a stationary container 1 and a movable container 2.

Figure 4:
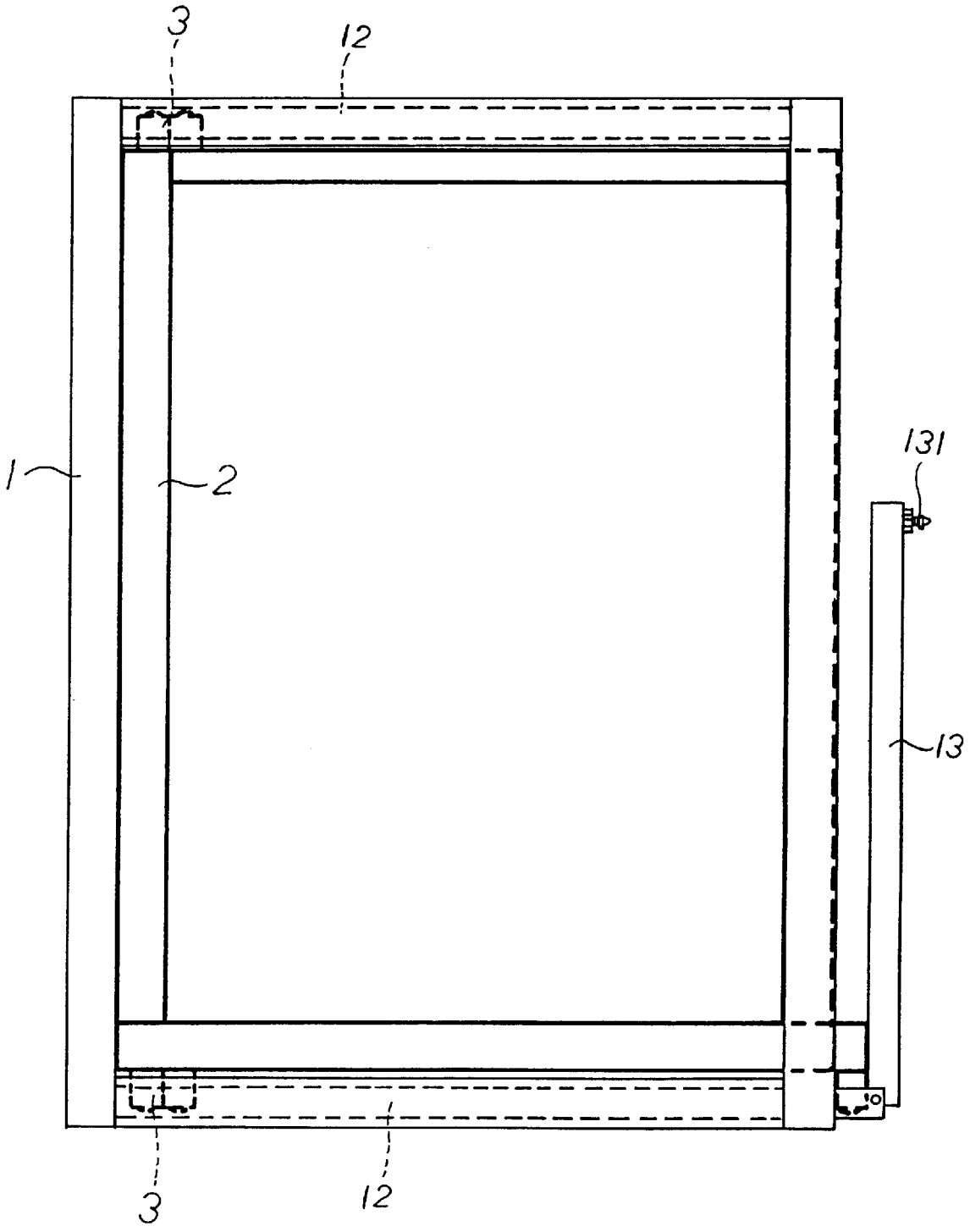
FIG. 4 is a side view of the present invention.
Figure 5B:
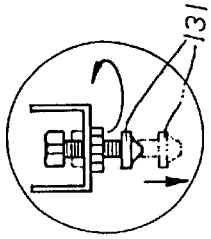
FIG. 5B is an enlarged view of a portion of FIG. 5.

The stationary container 1 is provided with a wall at each of the five sides and has at least an open side and the movable container 2 is movably fitted in the stationary container 1 from the open side. The stationary container 1 has a first pair of rails 12 at the upper and lower positions of one inner end thereof, a second pair of rails 12 at the upper and lower positions of the intermediate position thereof, and a third pair of rails 12 at the upper and lower positions of another inner end thereof A secondary rail 13 is pivotally connected to each of the lower rails 12 at two ends of the stationary container 1 which can be kept at a horizontal position as shown in FIG. 1A or a vertical position as shown in FIG. 4. The free end of the secondary rail 3 is provided with an adjust screw 131 for adjusting the height above the ground (see FIGS. 5A and 5B).

Figure 2:
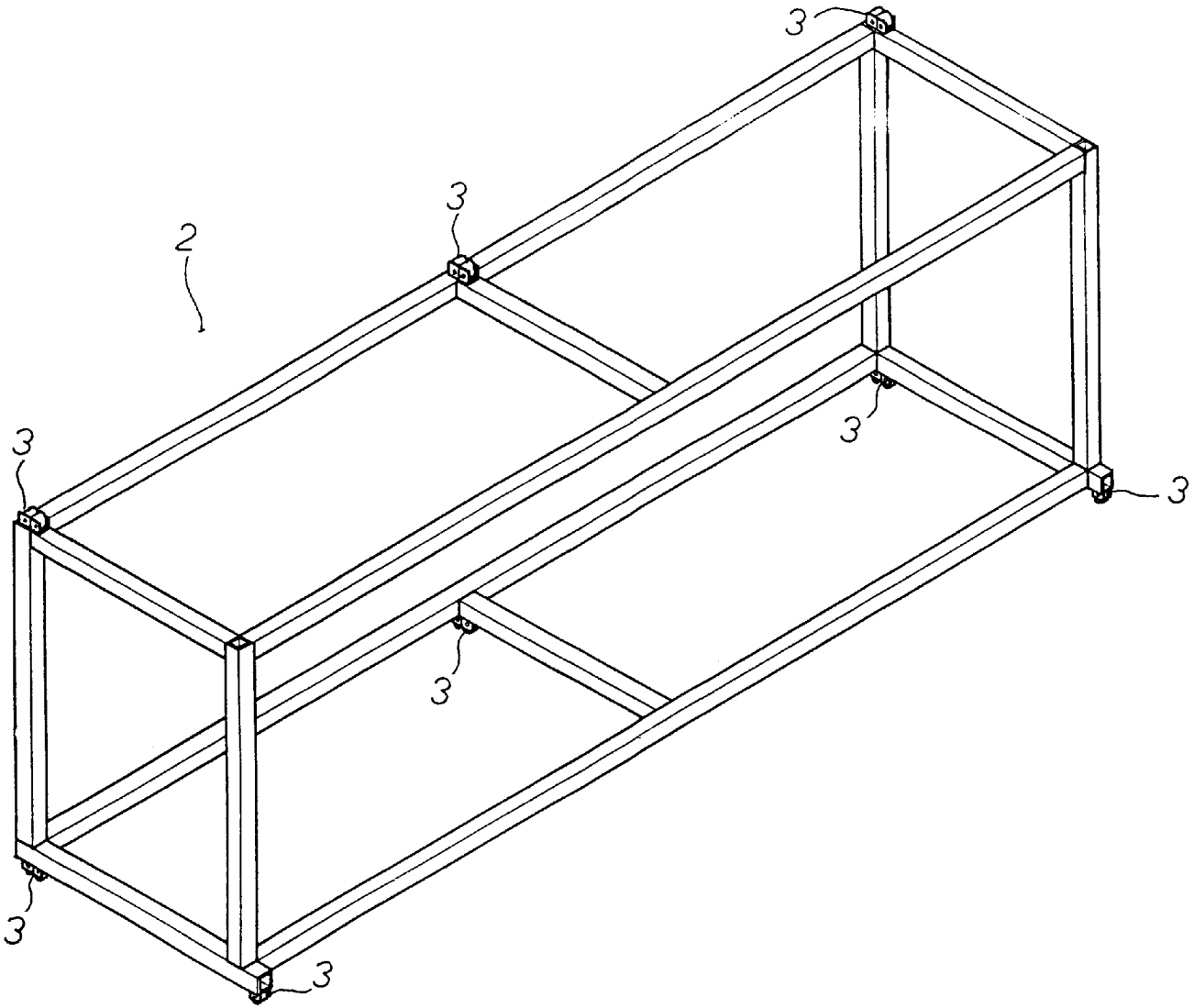
FIG. 2 is a perspective view of a skeleton of the movable container according to the present invention.
Figure 3:
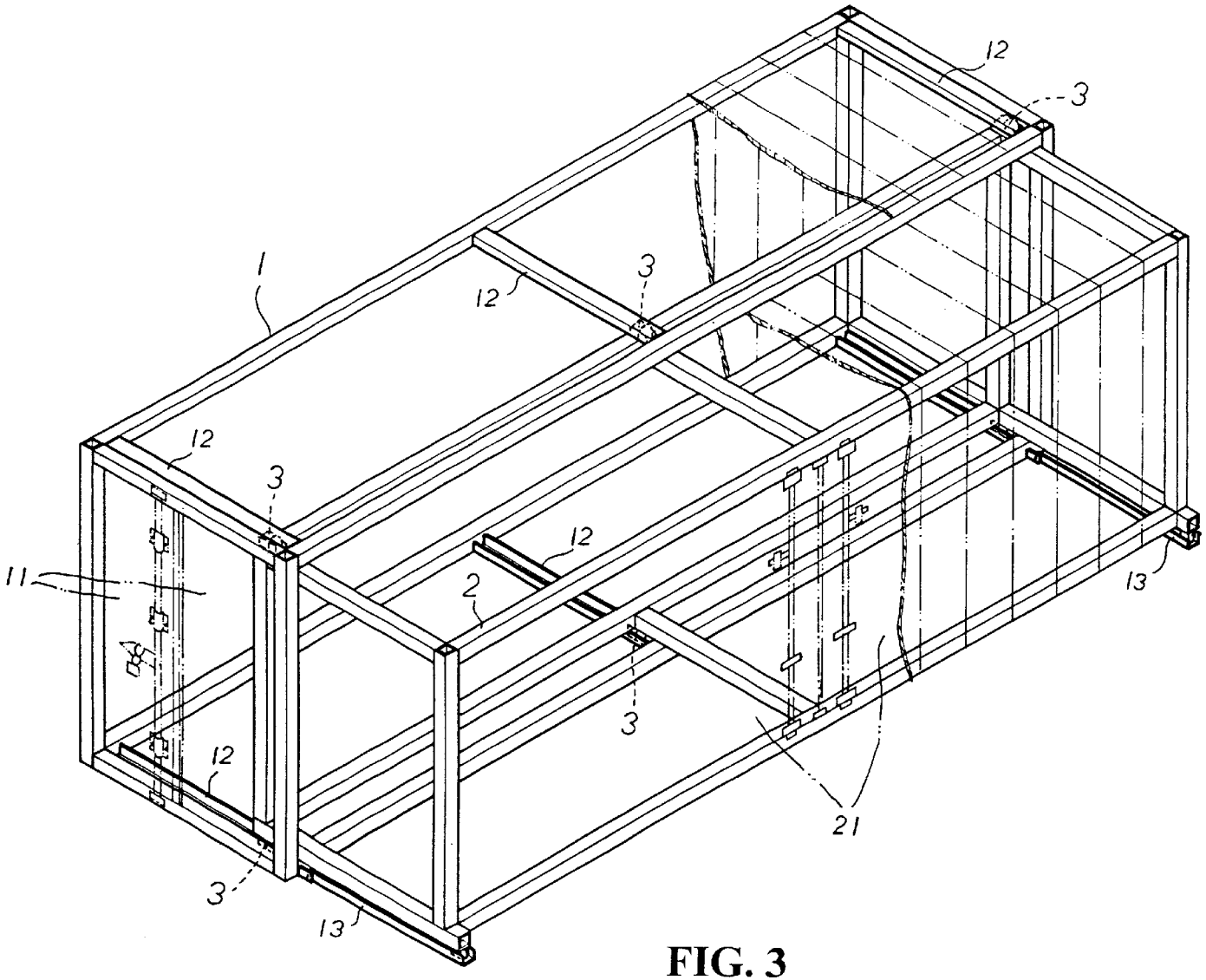
FIG. 3 is a perspective view of the present invention.
Figure 5A:
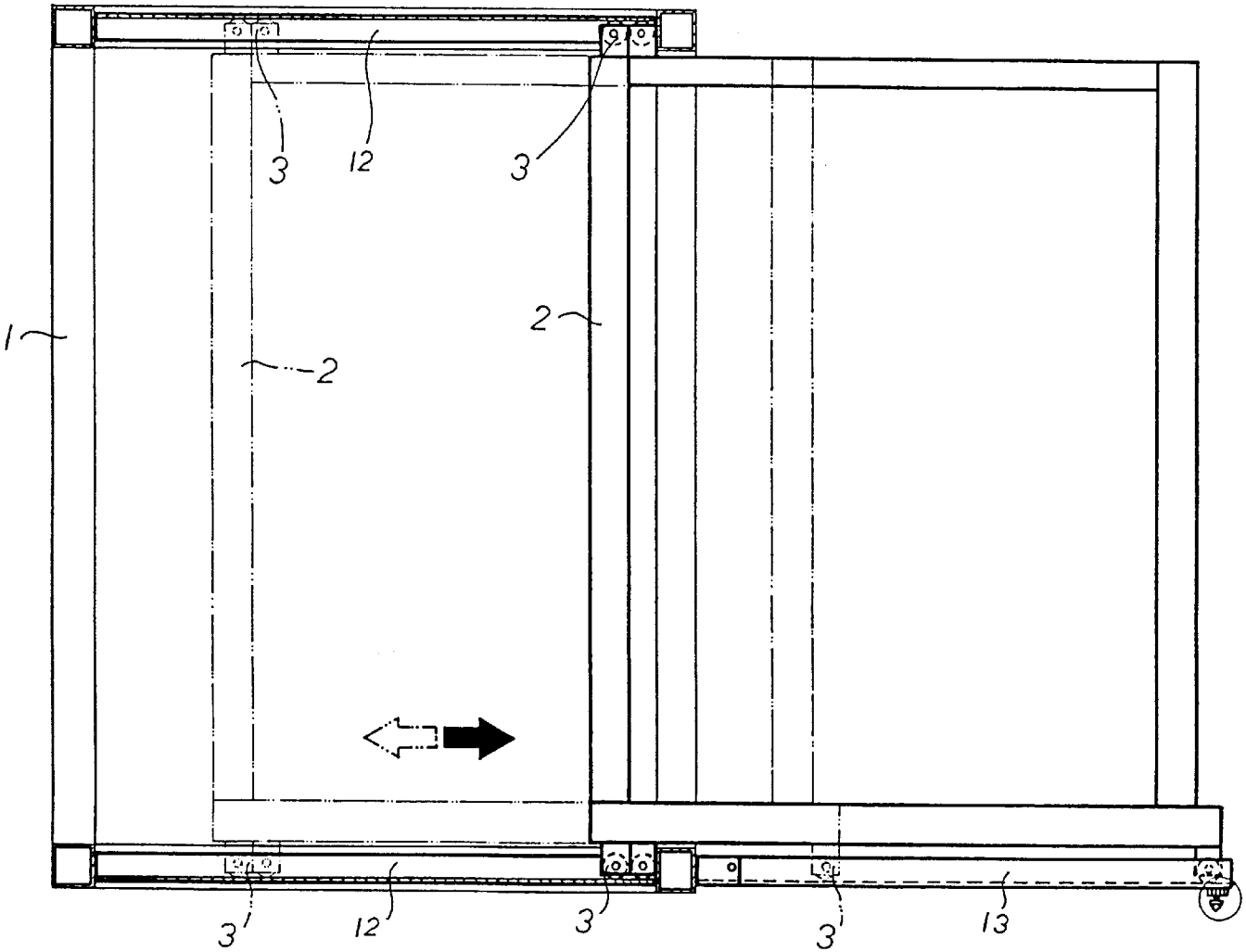
FIG. 5A illustrates how how the present invention is expanded in volume.

As shown in FIGS. 2 and 3, the movable container 2 is provided with a plurality of roller assemblies 3 which are positioned to be rotatably engaged with the rails 12 so that the movable container 2 can slide into the stationary container 1 (see FIG. 4) along the rails 12 and can slide out of the stationary container 1 along the rails 13 (see FIG. 5A). Further, the movable container 2 is provided with doors 21 (see FIG. 3).

Figure 6:
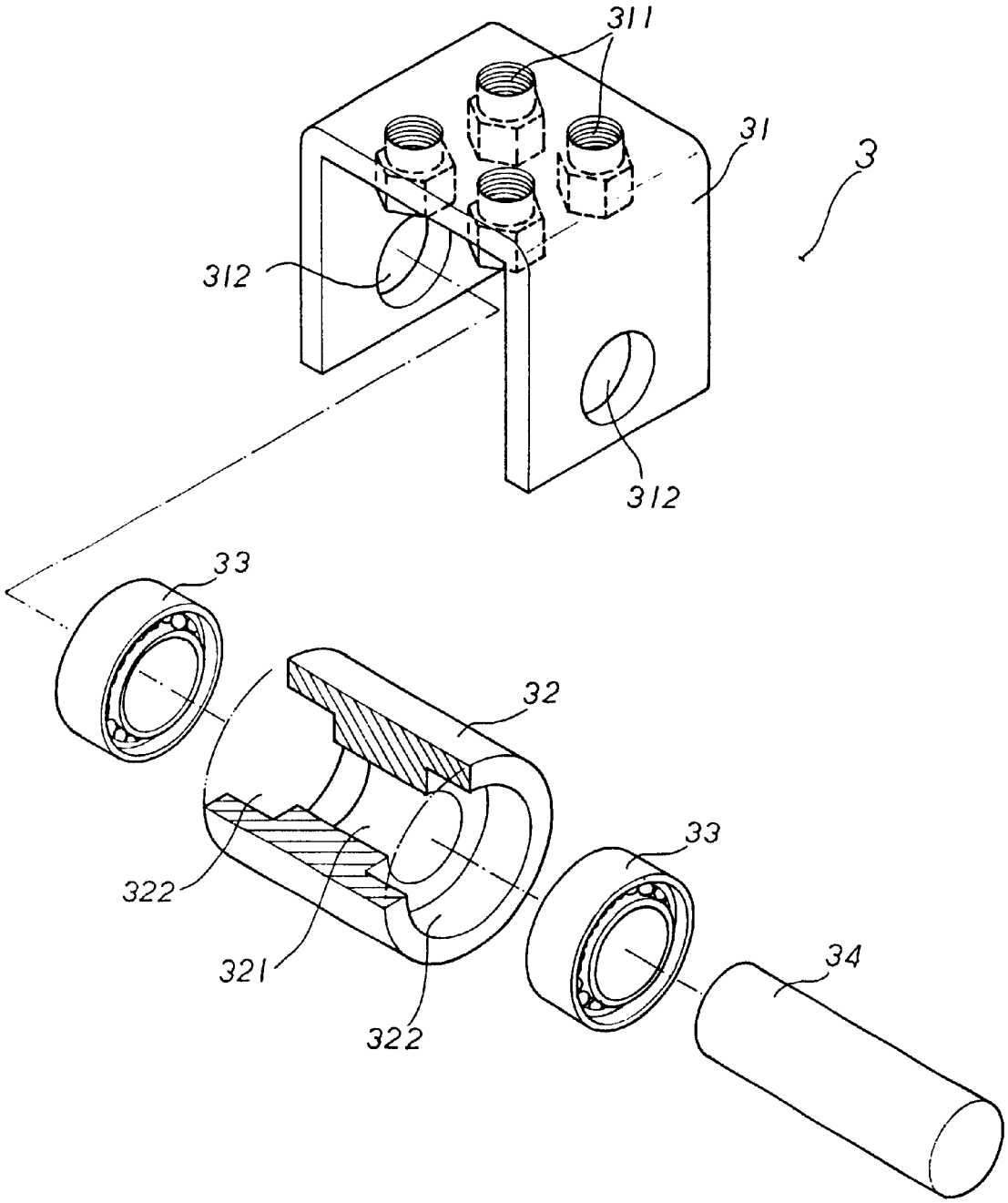
FIG. 6 is an exploded view of the roller assembly.
Figure 7:
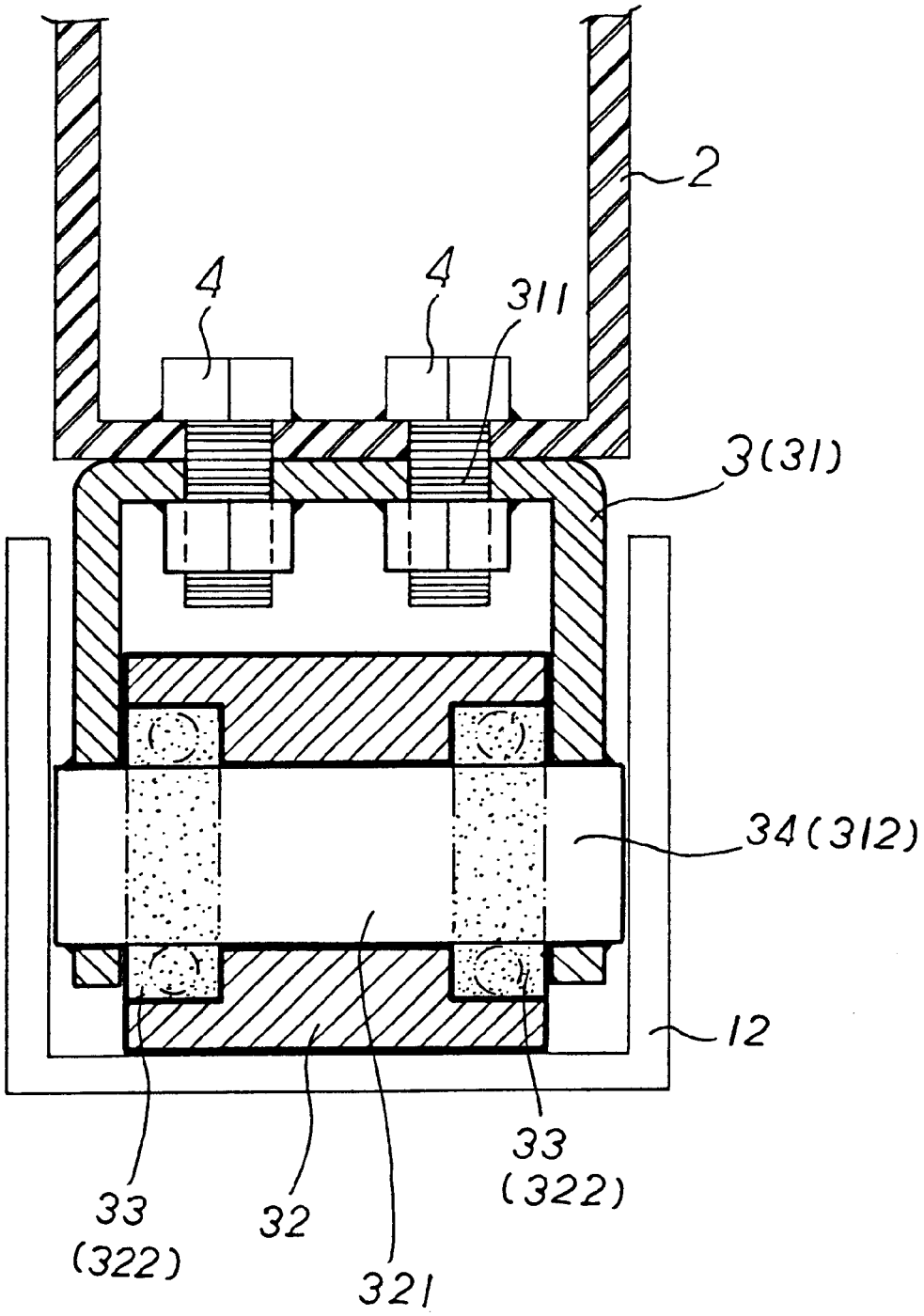
FIG. 7 is a sectional view of the roller assembly.

Referring to FIGS. 6 and 7, the roller assembly 3 includes an inverted U-shaped member 31, a cylindrical member 32, an axle 34 and two bearings 33. The inverted U-shaped member 31 is fixedly mounted on the skeleton of the movable container 2 by bolts 4 which extend through threaded holes 311 of the inverted U-shaped member 3 to engage with nuts. Then, the bolts 4 and the nuts are welded on the movable container 2 and the inverted U-shaped member 31, respectively. The inverted U-shaped member 31 is formed with two aligned holes 312. The cylindrical member 32 is formed with a through hole 321 and two circular recesses 322 at two ends thereof. The circular recess 322 has a larger diameter than the through hole 321 for receiving the bearing 33. The cylindrical member 32 is fitted in the inverted U-shaped member 31 and the axle 34 extends through the holes 312 of the inverted U-shaped member 31, the bearings 33 and the cylindrical member 32. The axle 34 is then fixedly mounted on the inverted U-shaped member 31 by welding, so that the cylindrical member 32 is rotatable with respect to the movable container 2.

When the movable container 2 is pushed into the stationary container 1, the present invention can be used as a normal container with the doors 21 for the entrance of goods into the container (see FIGS. 3 and 4). Further, the secondary rail 13 is moved to a vertical position and locked in place by a screw or the like (not shown) thereby preventing the movable container 2 from getting out of the stationary container 1. When desired to expand the volume of the stationary container 1, the secondary rail 3 is moved to a horizontal position, the adjust screw 131 is turned to adjust the distance of the secondary rail 3 above the ground, and then the movable container 2 is moved out of the stationary container 1 along the secondary rail 3 (see FIGS. 3 and 5A).

Accordingly, the present invention has the following advantages over the prior art:

1. The volume of the container can be enlarged as required.
2. The container when expanded can be used as a platform, coffee shop, assembled house, or temporary office, as required.
3. The present invention can be used for other purposes in addition to a container for goods.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A container comprising:

a stationary container having at least an open side and provided with a first pair of rails at upper and lower positions of one inner end thereof, a second pair of rails at upper and lower positions of another inner end thereof, two secondary rails being pivotally connected to each of said rails at lower positions, and a third pair of rails at upper and lower positions of intermediate position thereof, said movable container being provided with a roller assemblies adapted to engage with said third pair of rails; and a movable container provided with a plurality of roller assemblies which are positioned to be rotatably engaged with said rails to enable said movable container to slide into said stationary container along said rails and slide out of said stationary container along said rails.

2. The container as claimed in claim 1, wherein said roller assemblies includes an inverted U-shaped member, a cylindrical member, an axle and two bearings, said inverted U-shaped member being fixedly mounted on said movable container by bolts which extend through threaded holes of said inverted U-shaped member to engage with nuts, said inverted U-shaped member being formed with two aligned holes, said cylindrical member being formed with a through hole and two circular recesses at two ends thereof, said circular recess having a larger diameter than said through hole for receiving said bearing, said cylindrical member being fitted in said inverted U-shaped member and said axle extending through said holes of said inverted U-shaped member, said bearings and said cylindrical member, said axle being fixedly mounted on said inverted U-shaped member by welding.

3. The container as claimed in claim 2, wherein said bolts and nuts being welded on said movable container and said inverted U-shaped member respectively.

4. The container as claimed in claim 1, wherein said secondary rails are provided with an adjust screw for adjusting position of said secondary above ground.

* * * * *